United States Patent [19]

Masuda et al.

[11] Patent Number: 4,717,322

[45] Date of Patent: Jan. 5, 1988

[54] ROOTS-TYPE FLUID MACHINE

[75] Inventors: Naofumi Masuda, Nagoya; Hajime Takeshita, Toyota; Takahiro Iwase, Anjyo; Hiroyuki Mochizuki, Aichi; Takuo Sibata, Aichi; Takashi Miyake, Aichi; Nobuo Kobayashi, Toyota, all of Japan

[73] Assignee: Toyota Jidosha Kabushiki Kaisha, Toyota, Japan

[21] Appl. No.: 892,039

[22] Filed: Aug. 1, 1986

[51] Int. Cl.[4] ..... F04C 18/18; F04C 27/00

[52] U.S. Cl. ..... 418/144; 418/152; 418/178; 418/206

[58] Field of Search ..... 418/178, 152, 206, 144, 418/140

[56] References Cited

U.S. PATENT DOCUMENTS

| | | | |
|---|---|---|---|
| 2,491,678 | 12/1949 | McCulloch et al. | 418/152 X |
| 2,833,224 | 5/1958 | Meyer et al. | 418/206 X |
| 2,857,763 | 10/1958 | Hague et al. | 418/140 X |
| 2,944,732 | 7/1960 | Lorenz | 418/206 X |
| 4,225,295 | 9/1980 | Shimizu et al. | 418/178 X |
| 4,466,785 | 8/1984 | Biswas | 418/178 X |

FOREIGN PATENT DOCUMENTS 52-166913 12/1977 Japan .

OTHER PUBLICATIONS

Sae Technical Paper Series; "Developments of Volkswagon's Supercharger G-Lader"; B. Wiedemann, et al.; International Congress and Exposition, Detroit, Michigan, Feb. 24–28, 1986.

*Primary Examiner*—John J. Vrablik
*Assistant Examiner*—Eugene L. Szczecina, Jr.
*Attorney, Agent, or Firm*—Oblon, Fisher, Spivak, McClelland & Maier

[57] ABSTRACT

A Roots-type rotary fluid machine having resin-coated rotors fluid-tightly accomodated in a chamber formed in a housing structure which consists of a generally cup-shaped main housing body having a bore closed at its one end and open the other end, and a covering member which closes the open end of the bore in the housing body. The housing body includes a fillet portion which bridges an inner flat surface defining the bottom of the bore and facing one end face of each rotor, and an inner peripheral surface defining the periphery of the bore and facing the outer peripheral surface of each rotor. The fillet portion is formed along a line of intersection of extensions of the inner flat surface and the inner peripheral surface of the housing body, and inwardly into the bore from this line of intersection. The fillet portion has a generally triangular shape in cross section taken in a direction perpendicular to the above line of intersection.

7 Claims, 6 Drawing Figures

ROOTS-TYPE FLUID MACHINE

BACKGROUND OF THE INVENTION

1. Field of the Art

The present invention relates generally to a rotary fluid machine of a Roots type having resin-coated rotors, and more particularly to a technique for improving displacement efficiency of such type of rotary fluid machines.

2. Related Art Statement

In a rotary fluid machine of a Roots type such as rotary lobe-type pump or air compressor or blower, two lobes or rotors supported for rotation in opposite directions are accommodated in a chamber formed in a hollow housing structure, such that there exist small clearances between the outer surfaces of the two rotors, and between the outer surfaces of the rotors and the inner surfaces of the housing structure. It is desired to keep these clearance to a minimum, for ensuring maximum displacement efficiency of the fluid machine.

Referring to FIG. 4, there are partly shown one of two rotors 10 and a housing structure of a known fluid machine of the type indicated above. The housing structure consists of three pieces, that is, a main housing body 14 which has a bore which is open at its opposite ends, and a pair of covering members 16, 16 which close the opposite open ends of the bore and which cooperate with the housing body 14 to define a chamber 12 in which. the rotors 10 are accommodated. In this arrangement, the blanks for the housing body 14 and the covering members 16, 16 may be readily machined or processed so that the inner surfaces of the covering members 16, 16 defining the opposite ends of the chamber 12 are at right angles to the inner peripheral surface of the housing body 14. Accordingly, a clearance "a" between the outer peripheral surface of each rotor 10 and the inner surface of the housing body 14, and a clearance "b" between the end faces of the rotor 10 and the inner surface of the covering members 16, may be made comparatively small.

PROBLEM SOLVED BY THE INVENTION

Another known fluid machine uses a two-piece housing structure partly shown in FIG. 5. This modified housing structure consists of a generally cup-shaped main housing body 18 having a bore which is closed at its one end and closed at the other end, and a covering member (not shown in the figure) which closes the open end of the housing body 18. The housing body 18 and the covering member cooperate to define a chamber 20 for accommodating the rotors 10. In this case, it has been a common practice to form a recess 22 in the inner surface of the blank for the housing structure, for facilitating the machining of the blank so as to form the bottom and inner peripheral surfaces of the chamber 20. While the clearances "a" and "b" between the rotors 10 and the inner surfaces of the housing body 17 may be made relatively small as in the arrangement of FIG. 4, the recess 22 results in reducing the capability of sealing between the rotors 10 and the housing body 17, as compared with the sealing capability provided in the fluid machine using the three-piece housing structure. Thus, the arrangement of FIG. 5 suffers from comparatively low displacement efficiency.

SUMMARY OF THE INVENTION

It is therefore an object of the present invention to provide a rotary fluid machine of a Roots type having a housing structure including a generally cup-shaped main housing body, which is improved in displacement efficiency.

According to the invention, there is provided a rotary fluid machine of a Roots type including a housing structure which consists of a generally cup-shaped main housing body having a bore closed at one end thereof and open at the other end, and a covering member which closes the open end of the bore and which cooperates with the main housing body to define a chamber in which rotors are accommodated in a substantially fluid tight condition with respect to each other and to the housing structure, wherein each of the rotors has an outer surface which consists of opposite end faces, one of which faces an inner flat surface of the main housing body defining a bottom of the bore, and an outer peripheral surface facing an inner peripheral surface of the main housing body defining a periphery of the bore. The outer surface of the rotor is coated with a resin layer. According to the invention, the main housing body includes as an integral part thereof a fillet portion which bridges the inner flat surface and the inner peripheral surface thereof, which is formed along a line of intersection of extensions of the inner flat surface and the inner peripheral surface, and which projects inwardly into the bore with respect to the line of intersection, the fillet portion having a generally triangular shape in cross section taken in a direction perpendicular to the line of intersection.

In the rotary fluid machine of the present invention constructed as described above, the fillet portion of a substantially trangular shape is formed so as to connect the bottom wall of the bore in the main housing body, and the adjacent end of the peripheral wall which defines the bore. That is, the main housing body of the instant rotary fluid machine is not formed with a recess as provided at the bottom of the bore in the main housing body of the two-piece housing structure of the known rotary fluid machine previously described. Consequently, the displacement efficiency of the machine according to the invention is significantly improved, as compared with that of the known machine.

According to an advantageous feature of the invention, the generally triangular shape of the fillet portion is generally an equilateral triangle having an apex at the aforementioned line of intersection, and a base which consists of a pair of circular arcs connected to each other. Each circular arc has a center located within the bore.

According to another advantageous feature of the invention, the fillet portion is formed such that it slightly interferes with the resin layer of each rotor when the rotors are installed in position in the chamber during assembly of the rotary fluid machine. Namely, the resin-coated rotors are positioned such that the resin coating at the edge of the rotor elastically yields by a small amount, while being depressed against the fillet portion. In this condition, the clearances between the inner surfaces of the housing body and the rotors are small enough to assure a high level of displacement efficiency of the fluid machine. With the rotors operated in this condition during a run-in period of the fluid machine, the resin coating at the edge of the rotor wears until the elastic force between the fillet portion and the resin coating of the rotor is reduced below a certain level.

The resin layer preferably has an approximate thickness within a range from 0.3 mm to 1.5 mm. In one preferred form of the fluid machine, the resin layer is formed of a fluorocarbon resin.

The fillet portion is preferably continuous and coextensive with the line of intersection.

BRIEF DESCRIPTION OF THE DRAWINGS

The above and optional objects, features and advantages of the present invention will be better understood by reading the following detailed description of a preferred embodiment of the invention, when considered in connection with the accompanying drawings, in which.

DETAILED DESCRIPTION OF THE PREFERRED EMBODIMENT

To further clarify the principle of the present invention, the preferred embodiment of the invention will be described in detail, referring to the accompanying drawings.

Figure 1:
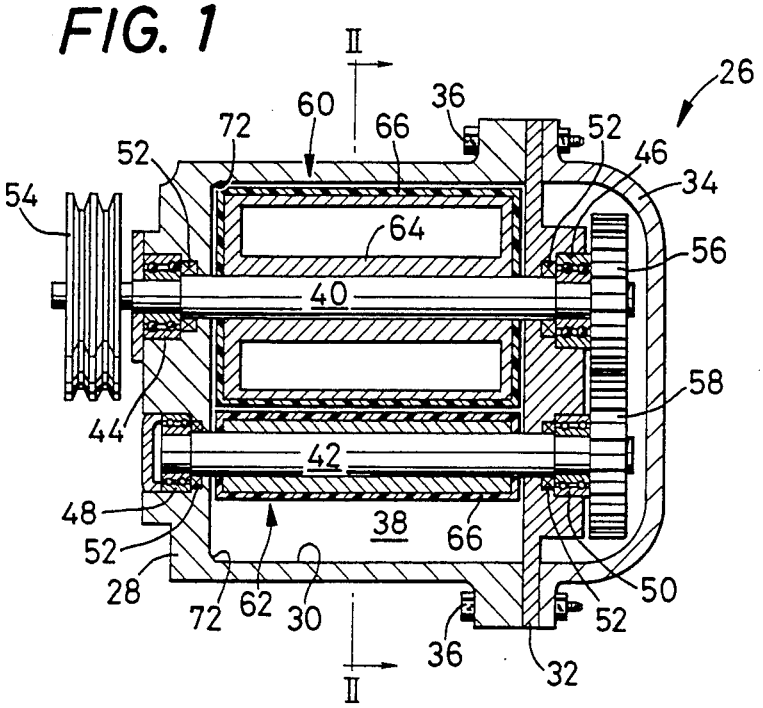
FIGS. 1 and 2 are front and side elevational views in cross section of one embodiment of a rotary fluid machine of a Roots type in the form of a supercharger for an engine of an automotive vehicle.
Figure 2:
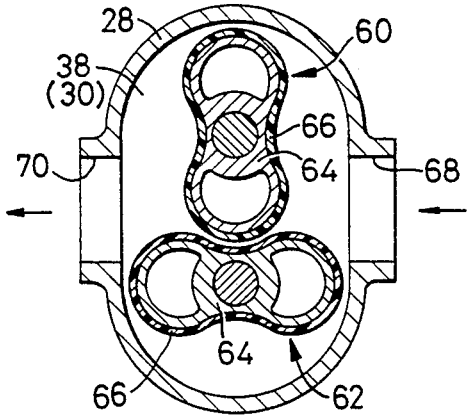

Referring first to FIGS. 1 and 2, there is shown a rotary fluid machine of a Roots type in the form of a supercharger 26 used for an engine of an automotive vehicle to increase volumetric efficiency by forcing a greater quantity of air into the cylinders. The housing structure of the Roots-type supercharger 26 consists of a generally cup-shaped, hollow main housing body 28, and a covering member in the form of an end plate 32. The main housing body 28 has a bore 30 with an elliptical transverse cross sectional shape. The bore 30 is closed at one end and open at the other end. The open end of the bore 30 is closed by the end plate 32 which is secured to the housing body 28 and to a rear cover 34, by means of bolts 36. Thus, the end plate 32 cooperates with the main housing body 28 to define a fluid-tight pump chamber 38.

The housing structure rotatably supports a pair of parallel support shafts 40, 42 which support a corresponding pair of lobe-type rotors 60, 62 accomodated in the pump chamber 38. Described in more detail, one of opposite ends of each shaft 40, 42 is rotatably supported by the main housing body 28, via respective bearings 44, 48 fixed in the bottom wall of the housing body 28 which defines the bottom of the bore 30, while the other end of each shaft 40, 42 is supported by the end plate 32, via respective bearings 46, 50 fixed in the end plate 32. Reference numeral 52 designates sealing members which are fluid-tightly mounted on the opposite end portions of the support shafts 40, 42, axially inwardly adjacent to the bearings 44, 46, 48, 50. The end portion of the support shaft 40 supported by the bearing 44 extends outwardly through the bottom wall of the housing body 28, and carries a pulley 54 fixed thereto outside the housing structure. The pulley 54 is connected by V-belts (not shown) to a suitable drive source such as the vehicle engine, or a dedicated drive motor. The other end portion extending through the end plate 32 carries a timing gear 56 fixed thereto. This timing gear 56 meshes with a timing gear 58 fixed to the end portion of the other support shaft 42. The two timing gears 56 and 58 have the same number of teeth. With the support shaft 40 driven via the a pulley 54, the two support shafts 40, 42 are rotated at the same angular velocity in opposite directions.

Each of the rotors 60, 62 has a pair of lobes which give the rotor a transverse cross sectional shape similar to the shape of a cocoon or peanut shell, as shown in FIG. 2. Each lobe-type rotor 60, 62 consists of a metallic core member 64 made of an aluminum alloy, iron or other suitable metals, and a resin layer 66 of a suitable thickness which covers the external peripheral surface and the opposite end faces of the core member 64. The resin layer 66 preferably has an approximate thickness in a range between 0.3 mm and 1.5 mm, and is formed of a fluorocarbon resin, for example, a copolymer of tetrafluoroethylene and ethylene. The two rotors 60, 62, which have the same dimensions and shape, are so disposed that there exists only a small clearance therebetween. With the two rotors 60, 62, rotated in the opposite directions upon rotation of the corresponding support shafts 40, 42, air is sucked into the pump chamber 38 through an inlet 68 formed in the housing body 28, and the air compressed by the rotors 60, 62 is discharged from the pump chamber 38 through an outlet 70 also formed in the housing body 28, whereby the compressed air is supplied to the vehicle engine.

Figure 3:
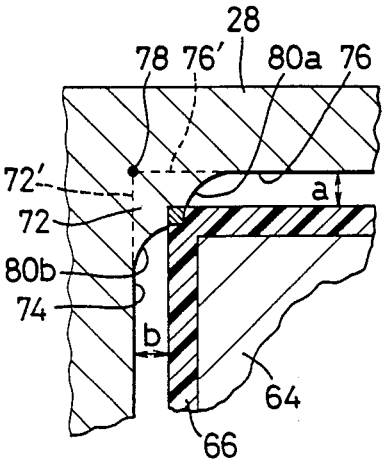
FIG. 3 is an enlarged fragmentary view of the supercharger of FIGS. 1 and 2.
Figure 4:
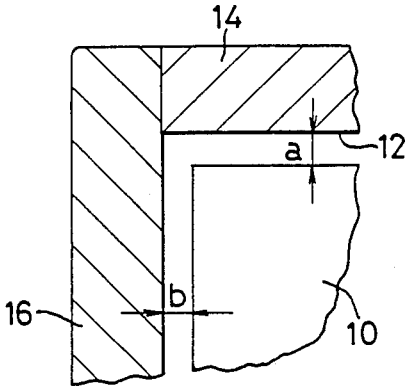
FIG. 4 PRIOR ART
FIGS. 4 and 5 are views corresponding to FIG. 3, showing known rotary fluid machines.

Referring further to FIG. 3, the bottom wall of the main housing body 28 has an inner flat surfaces 74 which defines the bottom of the bore 30, and which faces the end face of each rotor 60, 62. Further, the main housing body 28 has an inner peripheral surface 76 which defines the periphery of the bore 30 and which faces the outer peripheral surface of each rotor 60, 62. The peripheral edge of the inner flat surface 74 (bottom of the bore 30) is connected or bridged to the end of the inner peripheral surface 76 adjacent to the bottom of the bore 30, by means of a fillet portion 72. Described in greater detail, an extension 72' of the inner flat surface 74 and an extension 76' of the inner peripheral surface 76 intersect each other at right angles, at an imaginary line of intersection 78 which extends parallel to the peripheral surface 76 which defines the elliptical periphery of the bore 30 or pump chamber 38 as seen in FIG. 2. The fillet portion 72 is formed along the line of intersection 78, and projects inwardly of this intersection line 78 with respect to the bore 30 or pump chamber 38. As shown in FIG. 3, the fillet portion 72 has a generally triangular shape in cross section. More specifically, the triangulas shape of the fillet portion 72 is a generally equilateral-triangular cross section, taken in a direction perpendicular to the intersection line 78, such that an apex of the equilateral triangle is positioned at the intersection line 78, while a base **80*a*, 80*b* of the triangle connects the peripheral edge of the inner flat surface 74 and the end of the inner peripheral surface 76**.

As indicated in FIG. 3, the base consists of a pair of circular arcs **80*a*, 80*b* connected to each other. Each circular arc 80*a*, 80*b* has a center located within the bore 30. That is, the circular arcs 80*a*, 80*b* are convex toward the apex of the triangle or the intersection line 78. More specifically, the fillet 72 is left uncut when the surfaces 74, 76 are finished with suitable cutting tools (not shown). The radius of the circular arc 80***a*, 80*b* is equal to a radius of a cutting edge of the finish cutters used to finish the bore 30.

In this connection, it is noted that the rotors 60, 62 are installed in the pump chamber 38, at the time of assembly of the supercharger 26, such that the base 80a, 80b of the fillet portion 72 interferes with the edge of the resin layer 66 of each rotor 40, 42 by a small amount. In other words, the resin layer 66 of each rotor 60, 62 installed in position in the chamber 38 elastically yields a small amount while being depressed against the base 80*a*, 80*b* of the fillet portion 72. The cross sectional area of the fillet portion 72 as seen in FIG. 3, and the amount of interference of the resin layer 66 and the fillet portion 72, are determined so that the clearance "a" between the peripheral surface of the rotor 60, 62 and the opposite peripheral surface 76 of the housing body 28, and the clearance "b" between the flat surface 74 and the opposite end face of the rotor 60, 62 are small enough to assure a satisfactory level of displacement efficiency of the supercharger 26. The edge of the resin layer 66 depressed against the base 80*a*, 80*b* of the fillet portion 72 wears during a run-in period of the supercharger 26, until the elastic force between the resin layer 66 and the base 80*a*, 80*b* of the fillet portion 72 has been reduced below a certain level.

Figure 5:
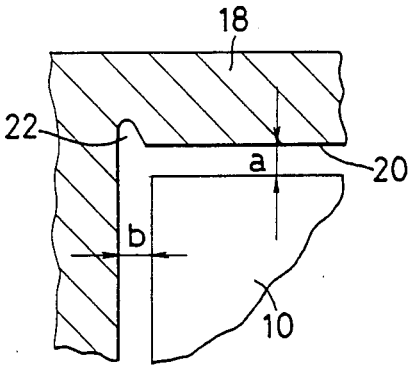
FIG. 5 PRIOR ART

As described above, the fillet portion 72 formed at the intersection of the inner flat surface 74 and the inner peripheral surface 76 of the main housing body 28 replaces the recess 22 (FIG. 5) as formed in the cup-shaped main housing body of the two-piece housing structure of the conventional fluid machine of the same type. Therefore, the displacement efficiency of the fluid machine in the form of the supercharger 26 is significantly improved owing to increased sealing between the rotors 60, 62 and the main housing body 28.

While the resin layer 66 is elastically depressed at its edge against the fillet portion 72 at the time of initial installation of the rotors 60, 62, as indicated in FIG. 3, so as to maintain the desired small clearance "a" and "b", the elastically depressed portion of the resin layer 66 may be easily removed due to wear in a run-in period of the supercharger 26. Thus, it is not necessary to form a recess (22) which had previously been considered necessary. Accordingly, the cost of forming the recess (22) in the housg body 28 is saved. In the present arrangement, the clearances "a" and "b" can be made as small as the clearances in the conventional fluid machine.

Figure 6:
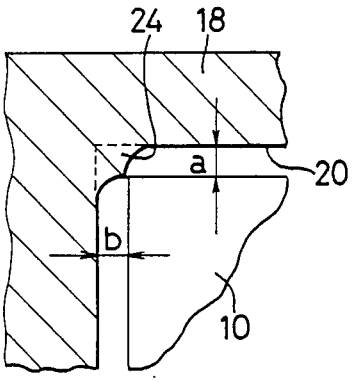
FIG. 6 is a view corresponding to FIG. 3, illustrating a modified arrangement of a rotary fluid machine which is conceived by the Applicant, but which does not meet the principle of the invention.

The above arrangement is compared with an arrangement of FIG. 6 which is not constructed according to the principle of the invention but provided for the purpose of explaining the principle of the invention. In the arrangement of FIG. 6, the rotor 10 is not coated with a resin layer, while the main housing body 18 is formed with a fillet 24 so as to connect the bottom and perpheral surfaces of the bore 20. In this case, the edge of the rotor 10 must not interfere with the fillet portion 24, since the rotor 10 is not covered with an elastic resin layer. Hence, the clearances "a" and "b" can not be made sufficiently small. Although it is possible to form the fillet portion 24 with dimensions small enough to obtain sufficiently small clearances "a" and "b" as indicated in FIG. 6, this requires highly accurate machining of the housing body 18 and the rotors 10 to within very tight tolerances, and high accuracy of positioning of the rotors 10 with respect to the fillet 24. This creates a high failure or defect rate, resulting in increased material and manufacturing costs of the supercharger. Hence, the arrangement of FIG. 6 is not a practical solution. It will be understood that the substitution of the fillet 72 of the illustrated embodiment for the recess 22 of the conventional arrangement requires the rotors 60, 62 to be coated with the resin layer 66.

Further, as compared with the bore 20 having the recess 22 of the conventional arrangement, the bore 30 can be cut or finished with a shorter feed length of the cutting tools and in a shorter length of time, since the fillet portion 72 is left uncut when the surfaces 74 and 76 are machined. This suggests a reduced machining cost and a reduced cost of the machining equipment.

While the fillet portion 72 provided in the illustrated embodiment takes the form of a generally equilateral triangle in cross section and its base consists of the two circular arcs 80*a*, 80*b*, the fillet portion 72 may take other substantially triangular forms, or the base of the triangle may consist of a single or three or more circular arcs. The principle of the invention may be practiced by other variations, provided the fillet portion 72 is formed inwardly of the line of intersection 78 with respect to the bore 30.

While the present embodiment has been described in its preferred embodiment with a certain degree of particularity for illustrative purposes only, it is to be understood that the invention is by no means confined to the precise details of the disclosure contained herein, but may be embodied with various changes, modifications and improvements which may occur to those skilled in the art, in the light of the foregoing teaching, without departing from the spirit and scope of the invention defined in the appended claims.

What is claimed is:

1. A rotary fluid machine of a Roots type comprising:

a housing structure including a generally cup-shaped main housing body having a bore therein, said bore being closed at one end thereof and open at another end, said housing structure further including a covering member which closes said another open end of said bore and which cooperates with said main housing body to define a chamber;

a plurality of rotors accommodated in said chamber in a substantially fluid tight condition with respect to each other and to said housing structure, wherein each of said rotors has an outer surface including opposite end faces, one of which faces an inner flat surface of said main housing body defining said closed end of said bore, said outer surface of each of said rotors also including an outer peripheral surface facing an inner peripheral surface of said main housing body, said inner peripheral surface of said main housing body defining a periphery of said bore;

a resin layer being coated on said outer surface of said each rotor; and a fillet portion integral with said main housing body, said fillet portion bridging said inner flat surface and said inner peripheral surface, said fillet portion being formed along a line of intersection of extensions of said inner flat surfce and said inner peripheral surface, said fillet portion projecting into said bore with respect to said line of intersection, said fillet portion having a generally triangular shape in cross section taken in a direction perpendicular to said line of intersection, said plurality of rotors being positioned relative to a base of said generally triangular shape of said fillet portion for minimum amounts of clearances between said outer peripheral surface of said each rotor and said inner peripheral surface of said main housing body, and between said one end face of said each rotor and said inner flat surface of said main housing body.

2. A rotary fluid machine according to claim 1, wherein said generally triangular shape of said fillet portion is generally an equilateral triangle having an apex at said line of intersection, and a base which consists of a pair of circular arcs connected to each other, each of said circular arcs having a center located within said bore.

3. A rotary fluid machine according to claim 1, wherein said fillet portion slightly interferes with said resin layer of said each rotor when said rotors are installed in position in said chamber during assembly of the rotary fluid machine.

4. A rotary fluid machine according to claim 1, wherein said resin layer has an approximate thickness within a range from 0.3 mm to 1.5 mm.

5. A rotary fluid machine according to claim 1, wherein said resin layer is formed of a fluorocarbon resin.

6. A rotary fluid machine according to claim 1, wherein said fillet portion comprises a continuous fillet portion coextensive with said line of intersection.

7. A rotary fluid machine of a Roots type comprising:

a housing structure including a generally cupshaped main housing body having a bore therein, said bore being closed at one end thereof and open at another end, said housing structure further including a covering member which closes said another open end of said bore and which cooperates with said main housing body to define a chamber;

a plurality of rotors accommodated in said chamber in a substantially fluid tight condition with respect to each other and to said housing structure, wherein each of said rotors has an outer surface including opposite end faces, one of which faces an inner flat surface of said main housing body, said inner flat surface of said main housing body defining said closed end of said bore, said outer surface of each of said rotors also including an outer peripheral surface facing an inner peripheral surface of said main housing body, said inner peripheral surface of said main housing body defining a periphery of said bore;

a resin layer being coated on said outer surface of said each rotor; and a fillet portion integral with said main housing body, said fillet portion bridging said inner flat surface and said inner peripheral surface, said fillet portion being formed along a line of intersection of extensions of said inner flat surface and said inner peripheral surface, said fillet portion projecting into said bore with respect to said line of intersection, said fillet portion having a generally triangular shape in cross section taken in a direction perpendicular to said line of intersection, said generally triangular shape being generally an equilateral triangle having an apex at said line of intersection, and a base which consists of a pair of circular arcs connected to each other, each of said circular arcs having a center located within said bore.

* * * * *